US005269532A

United States Patent [19]

Tucker et al.

[11] Patent Number: 5,269,532

[45] Date of Patent: Dec. 14, 1993

[54] LACROSSE STICK HEAD

[75] Inventors: Robert B. C. Tucker; William C. Crawford, both of Baltimore; Fielding H. Lewis, Jr., Queenstown; Jackie L. Davis, Aberdeen, all of Md.

[73] Assignee: STX, Inc., Baltimore, Md.

[21] Appl. No.: 1,767

[22] Filed: Jan. 7, 1993

[51] Int. Cl.[5] ..... A63B 59/02

[52] U.S. Cl. ..... 273/326

[58] Field of Search ..... 273/326

[56] References Cited

U.S. PATENT DOCUMENTS

| | | | |
|---|---|---|---|
| 3,507,495 | 4/1970 | Tucker et al. | 273/326 |
| 3,702,702 | 11/1972 | Hoult | 273/326 |
| 3,822,062 | 7/1974 | Tucker et al. | 273/326 |
| 3,905,088 | 9/1975 | Tucker et al. | 273/326 |
| 4,034,984 | 7/1977 | Crawford et al. | 273/326 |
| 4,037,841 | 7/1977 | Lewis, Jr. | 273/326 |
| 4,207,918 | 6/1980 | Lewis, Jr. | 273/326 |
| 4,739,994 | 4/1988 | Lewis, Jr. | 273/326 |
| 5,035,434 | 7/1991 | Taylor et al. | 273/326 |
| 5,174,580 | 12/1992 | Pratt | 273/326 |

*Primary Examiner*—William H. Grieb
*Attorney, Agent, or Firm*—Breiner & Breiner

[57] ABSTRACT

A unitary head for a lacrosse stick comprising a frame and webbing, wherein the webbing integrally molded to the head frame has a first ball receiving continuous curvature and a second continuous curvature in the pocket area of the webbing wherein the second curvature has an angle of curvature greater than the first curvature and wherein the side walls of the frame are separated by at least 2 inches in the area of the pocket and the pocket has a maximum depth of 3⅝ inches. The lacrosse stick has improved playing characteristics.

10 Claims, 2 Drawing Sheets

LACROSSE STICK HEAD

FIELD OF THE INVENTION

This invention relates to lacrosse sticks and, more particularly, a lacrosse stick head having a unitary plastic construction in which the pocket area of the head which receives and retains a lacrosse ball has critical dimensions with respect to width between the side walls across the pocket area and the depth of the pocket. The integral webbing of the head also has a first continuous curvature from the point of maximum depth of the pocket to the scoop area of the webbing and a second continuous curvature from the point of maximum depth of the pocket to the throat area of the head. The novel stick has improved playing characteristics.

BACKGROUND OF THE INVENTION

In the early prior art, lacrosse sticks were customarily made of wood, usually hickory, shaped by American Indians with whom the game originated. Such lacrosse sticks lacked uniformity as to quality, strength, weight, and feel in the hands of a player.

To overcome the disadvantages of the prior art, Tucker et al in U.S. Pat. No. 3,507,495 disclosed a lacrosse stick having an elastomeric frame. Since that time, great strides have been made in the construction of lacrosse stick heads and handles. For example, U.S. Pat. Nos. 3,822,062 and 3,905,088 to Tucker et al and U.S. Pat. No. 4,034,984 to Crawford et al disclose elastomeric lacrosse stick heads and parts therefor which have further dramatically revolutionized the sport of lacrosse. Additionally, U.S. Pat. Nos. 4,739,994; 4,037,841, and 4,206,918 to Lewis disclose novel lacrosse stick handles which have still further enhanced the quality of lacrosse sticks.

Moreover, Tucker et al in Canadian Patent No. 1,109,091, issued Sep. 15, 1981, describe a lacrosse stick having a head of integral plastic construction. This lacrosse stick has been sold by STX, Inc., Baltimore, Md., the assignee of the Canadian patent, under the trade name 'STXBALL." Although the stick has received substantial recognition, it has been accepted primarily as a lacrosse stick for use in physical education play or casual type play.

PRIMARY OBJECT AND SUMMARY OF THE INVENTION

It is a primary object of the present invention to provide a new lacrosse stick with a head having a unitary plastic frame and pocket for use as a beginner stick, or as a stick for recreation by accomplished players. The lacrosse stick head has critical dimensions and shape which facilitate receiving a ball into the pocket of the lacrosse stick head and retaining the ball.

According to the present invention, the lacrosse stick head is made of a molded plastic material such as low density polyethylene, high density polyethylene, nylon or the like. The unitary head comprises a frame made up of a stop or throat area, side walls extending from the stop or throat area to a scoop, and a webbing including a pocket area. The open face of the lacrosse stick frame is dimensioned in order that the width between the side walls of the frame directly inwardly spaced from the deepest point of the molded pocket area of the webbing is at least 2 inches, with the depth from the deepest point of the pocket to the open surface of the lacrosse stick frame being no more than about 3⅝ inches. The overall length of the head from the stop area of the head to the extremity of the scoop area is from about 8 to 10 inches. As another important feature, the plastic webbing has a first continuous curvature from the point of maximum depth of the pocket to the scoop. This curvature is designed to guide the ball into the pocket. There is a second continuous curvature from the point of maximum depth of the pocket down to the throat area. The slope of the second curvature is greater than the slope of the first curvature and forms the pocket for receiving and retaining the ball.

These critical dimensions of the head and curvatures of the webbing provide a lacrosse stick which has excellent play characteristics when using a ball having a diameter ranging from about 2 inches up to about 3 inches. The first curvature of the webbing is designed in order to facilitate receiving a projected ball and the guiding of that ball into the pocket area. It has been found that the angle of this first curvature is more critical the harder or more rigid the polymer used in forming the webbing. Thus, a webbing of softer characteristics will receive the ball and absorb the impact energy, at least to a limited extent. A harder polymer material will not absorb the impact energy as readily, causing the ball to rebound to a greater extent, requiring greater control by the angle of curvature. The second curvature, or the curvature of the pocket, holds the ball once in the pocket.

THE DRAWING AND DETAILED DESCRIPTION

Figure 1:
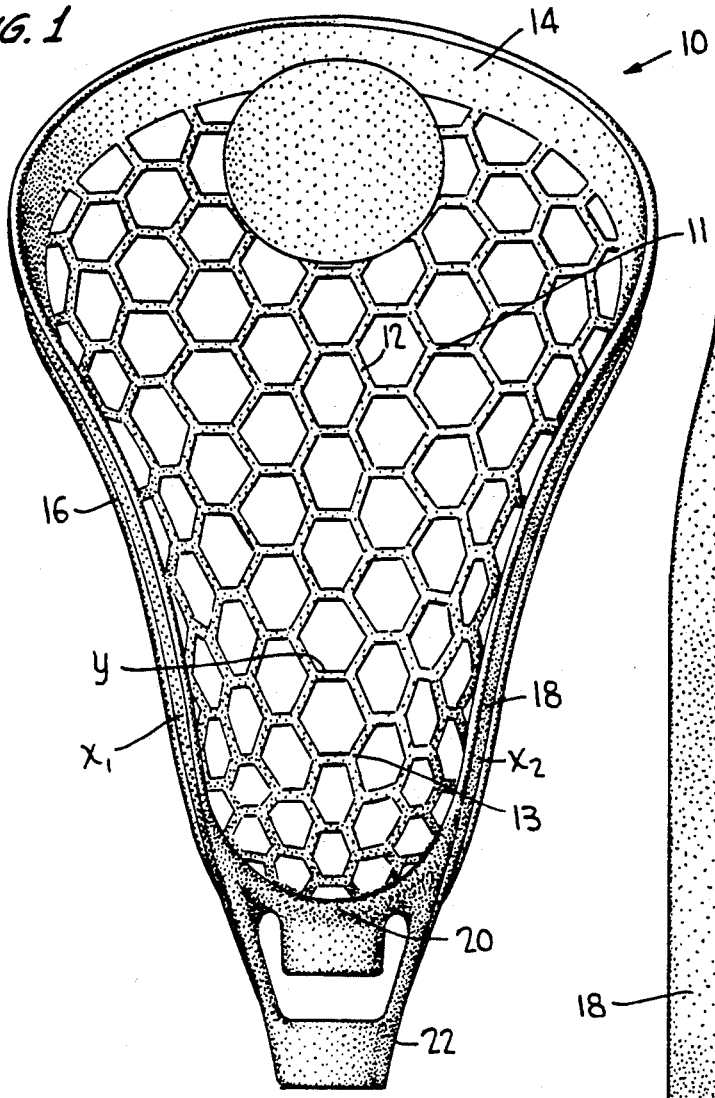
FIG. 1 is a front view relative to the ball receiving surface of the integral lacrosse stick head of the invention.

The lacrosse stick head of the present invention generally designated 10 includes a frame comprising scoop 14 and side walls 16 and 18, stop area 20 and handle area 22. The frame is designed and constructed similarly to the frame of the head disclosed in Tucker et al, U.S. Pat. No. 3,507,495, and has a generally V-shaped configuration. As illustrated, the lower end of the head is formed as a throat 20 from which the two side walls 16 and 18 are inclined and diverge upwardly and outwardly and closed by scoop or transverse wall 14. The handle area 22 is designed to receive the handle, not shown, of the lacrosse stick. A webbing 12 is integral with the frame and includes a ball guiding area 11 and a pocket area 13.

Figure 2:
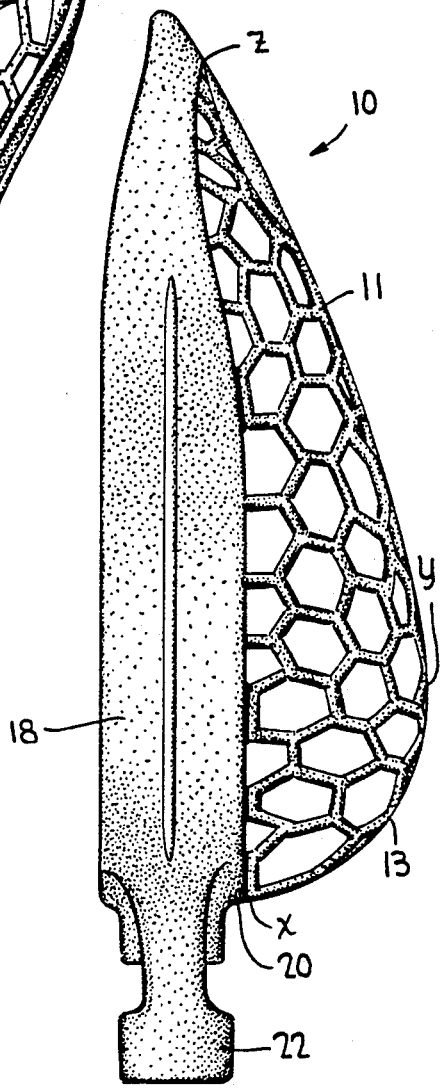
FIG. 2 is a side view of the lacrosse stick head.
Figure 3:
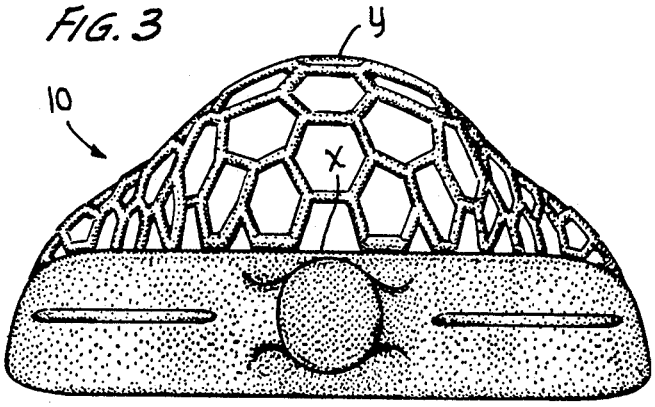
FIG. 3 is an end view from the throat end of the lacrosse stick head.
Figure 4:
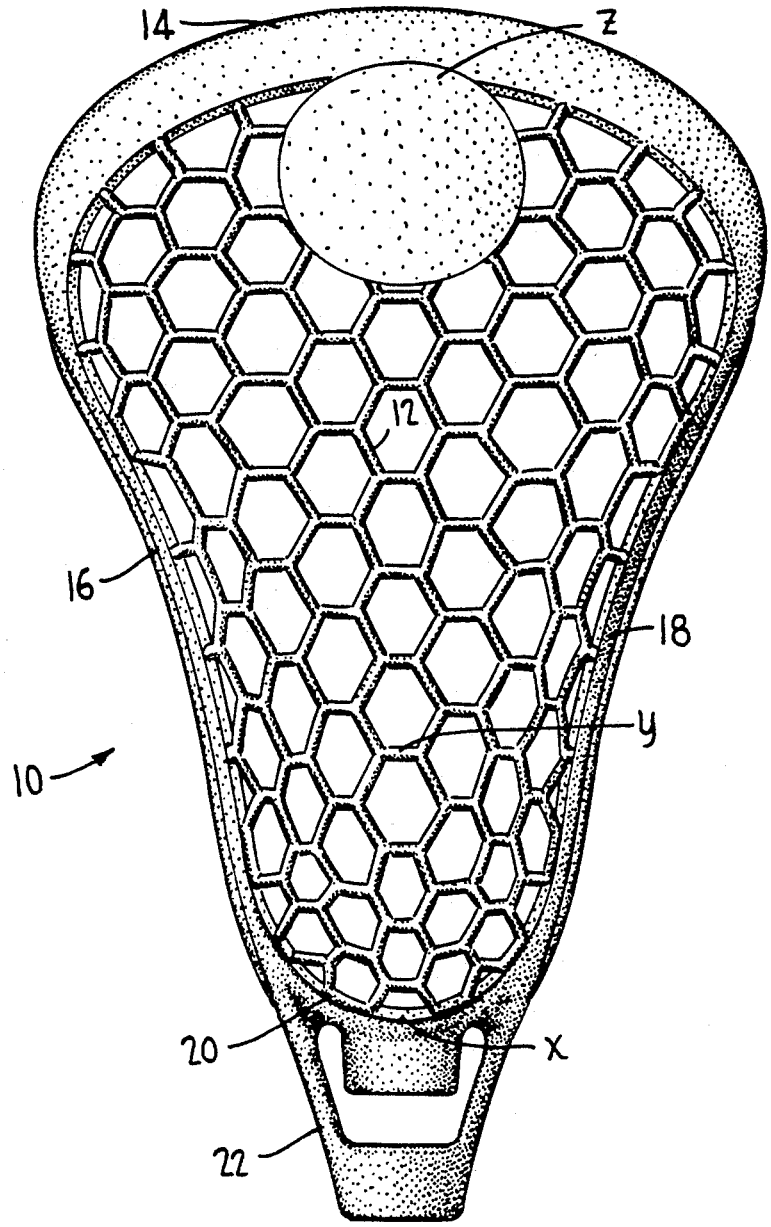
FIG. 4 is a view from the pocket side of the lacrosse stick head.
Figure 5:
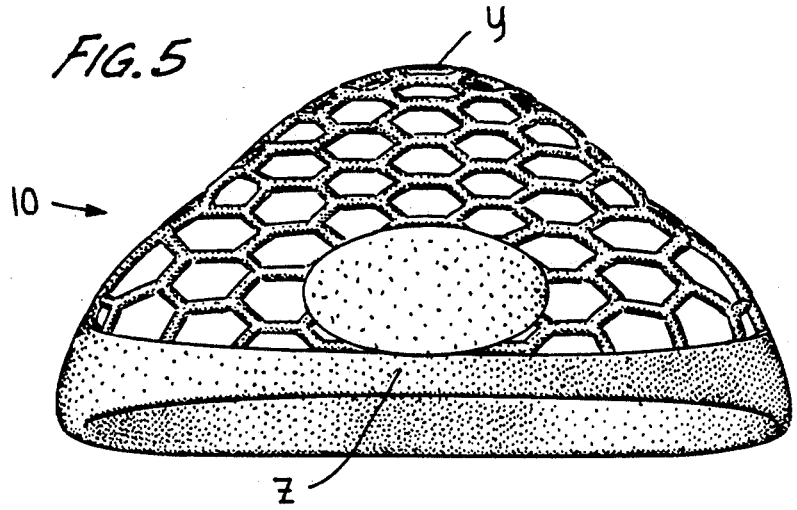
FIG. 5 is an end view from the scoop end of the lacrosse stick head.

As best shown in FIGS. 1 and 2 of the drawing, the deepest point of the pocket 13 is at Y. The critical dimension between side walls 16 and 18 is at points X1 and X2 which extend substantially across from the maximum depth Y of the pocket. The width between X1 and X2 must be at least 2 inches, preferably from 2 to 3½ inches, and most optimally is approximately 2 11/16 inches. The maximum depth from point Y of the pocket to the surface of a line joining X1 and X2 is at most a distance of 3⅝ inches, preferably is from 2⅝ to 3⅝ inches, and optimally is 3 inches. The overall length of the stick from the scoop end 14 to the end of the handle area 22 is from 8 to 10½ inches.

As best shown in FIG. 2, there is a first curvature of the webbing 12 extending from point Z at the center of the scoop end to point Y. There is a second curvature from point Y to the center of the stop area X. The continuous curvature between Z and Y is more shallow than the curvature from Y to X. The preferred radius of curvature between Y and Z is 12 inches, and the preferred radius of curvature between Y and X is 2 inches. The radius of curvature between Y and Z can vary from 10 inches to 40 inches and the radius of curvature between Y and X can vary from 0.75 inches to 2.25 inches, it being required, however, that the curvature between Y and X is the sharper curvature. These curvatures provide for improved play.

Keeper Strap 30, as shown in FIG. 1, will extend from wall 16 to wall 18 substantially in the area directly inward from point Y. Keeper Strap is a trademark of STX, Inc., Baltimore, Md. The Keeper Strap may or may not be used during play and retains the ball in position during play, particularly when beginners are learning the game of lacrosse.

As is apparent, the lacrosse stick of the present invention is not a regulation lacrosse stick but rather is designed primarily for beginners learning the game of lacrosse, or for casual play by accomplished lacrosse players.

The unitary head is formed by molding a polymer material characterized by toughness, high impact resistance and good flexibility, as well as other desirable properties explained in the aforesaid U.S. Pat. No. 3,507,495. Presently preferred materials are low density polyethylene, high density polyethylene, and a nylon resin marketed under the DuPont trademark ZTEL ST 801. This polymer has outstanding impact resistance and good moldability, permitting injection molding. Unreinforced ZTEL ST 801, with a water content of 0.2%, at 73° F. using the ASTM test method D638 has a tensile strength of 7800 psi, a yield strength of 7800 psi, and an elongation at break of 40%. It has a specific gravity of 1.09 using the ASTM test method D792, and a Rockwell hardness of R112 using ASTM test method D785. Another preferred material is an injection moldable polymer material sold under the DuPont trademark HYTREL. Still another material suitable for making head 10 is the reaction product of Adiprene L315 and 4,4'-methylene-bis-(2-chloroaniline) using the formulation and manufacturing procedure as set forth in the aforesaid U.S. Pat. No. 3,507,495, the disclosure of the '495 patent being incorporated herein by reference.

The design of the webbing shown in the drawing is a preferred design from the standpoint of appearance. The openings in the plastic forming the webbing are rounded at all surfaces to avoid sharp edges for safety purposes. Other designs of the webbing and of the frame of the head, including a straight walled frame, can be used.

Various modifications will be recognized by those skilled in the art based on the present teaching. Thus, although only select preferred embodiments have been specifically illustrated and described herein, it is to be understood that various modifications and embodiments can be utilized to provide the lacrosse stick of the present invention without departing from the spirit of the invention and the scope of the appended claims.

It is claimed:

1. A unitary head for a lacrosse stick comprising a generally V-shaped plastic molded open faced frame comprising two side walls joined at a juncture and diverging therefrom and a transverse wall joining the ends of said side walls opposite of said juncture, and a plastic webbing integrally molded with said side walls and transverse wall of said frame to join said side walls and transverse wall, said webbing having a ball receiving area and a ball pocket area, said webbing further having a first continuous curvature extending from the transverse wall to a point in said pocket area where said pocket has its greatest depth, and a second continuous curvature from said point of greatest depth in said pocket to said juncture, said second curvature having an angle of curvature greater than the angle of curvature of said first curvature, said side walls at the point immediately adjacent the pocket area of greatest depth being separated by a width of at least 2 inches and the maximum depth of the pocket area to the surface of the open faced frame being a maximum of 3⅝ inches.

2. The unitary head of claim 1 wherein the overall length of said head from the juncture to the transverse wall is from about 8 to 10 inches.

3. The unitary head of claim 2 wherein the width separating the side walls is from about 2 inches to about 3 inches and the maximum depth of the pocket is 3 inches.

4. The unitary head of claim 1 wherein the webbing is formed of a plurality of hexagons wherein said hexagons have rounded edges.

5. The unitary head of claim 1 wherein the juncture is constructed and arranged to removably receive a handle.

6. The unitary head of claim 1 wherein the plastic is low density polyethylene.

7. The unitary head of claim 1 wherein the plastic is high density polyethylene.

8. The unitary head of claim 1 wherein the plastic is nylon.

9. The unitary heading of claim 1 including a flexible member positioned across the face of the lacrosse stick constructed and arrange to partially enclose the pocket.

10. The unitary head of claim 9 wherein said flexible member is integrally molded with the unitary head.

* * * * *